US009795894B2

(12) United States Patent
Chieffo

(10) Patent No.: US 9,795,894 B2
(45) Date of Patent: Oct. 24, 2017

(54) MAGNETIC LEVITATION DEVICE AND METHOD

(71) Applicant: Joseph Chieffo, Wilmington, DE (US)

(72) Inventor: Joseph Chieffo, Wilmington, DE (US)

( * ) Notice: Subject to any disclaimer, the term of this patent is extended or adjusted under 35 U.S.C. 154(b) by 427 days.

(21) Appl. No.: 13/965,167

(22) Filed: Aug. 12, 2013

(65) Prior Publication Data

US 2015/0044938 A1 Feb. 12, 2015

(51) Int. Cl.
*A63H 33/26* (2006.01)
*A63H 1/00* (2006.01)

(52) U.S. Cl.
CPC ..... *A63H 33/26* (2013.01); *A63H 1/00* (2013.01)

(58) Field of Classification Search
CPC .. A63H 33/26; A63H 1/00; A63F 9/16; A63F 9/34; H01F 7/02; H01F 7/0236
See application file for complete search history.

(56) References Cited

U.S. PATENT DOCUMENTS 3,318,043 A * 5/1967 Abbott ..... A63H 33/26 446/133
3,335,519 A * 8/1967 Elward ..... A63H 1/00 273/109
3,783,550 A * 1/1974 Andrews ..... A63F 7/26 446/484
4,382,245 A * 5/1983 Harrigan ..... H01F 7/0236 181/0.5
4,585,282 A * 4/1986 Bosley ..... F16C 32/0451 104/284
5,404,062 A * 4/1995 Hones ..... H02N 15/00 310/90.5
5,883,454 A * 3/1999 Hones ..... F16C 32/0436 310/90.5
6,413,138 B1 * 7/2002 Dokoupil ..... H02N 15/00 446/129
6,485,017 B1 * 11/2002 Ng ..... A63F 9/0078 273/108
6,608,540 B1 * 8/2003 Hones ..... H02N 15/00 310/90.5
6,683,776 B2 * 1/2004 Belisle ..... B64G 1/002 361/143
8,294,542 B2 * 10/2012 Wang ..... A63H 33/26 335/285
8,803,646 B2 * 8/2014 Farber ..... H02K 7/09 335/296
2006/0044094 A1 * 3/2006 Davis ..... A63H 33/26 335/220
2007/0021029 A1 * 1/2007 Weidetz ..... A63F 9/16 446/256
2007/0170798 A1 * 7/2007 Gohin ..... H02N 15/00 310/90.5
2008/0200092 A1 * 8/2008 Chung ..... G09F 19/02 446/131

(Continued)

FOREIGN PATENT DOCUMENTS

GB 2425576 A * 11/2006 ..... F16C 32/0429

*Primary Examiner* — Gene Kim
*Assistant Examiner* — Alyssa Hylinski
(74) *Attorney, Agent, or Firm* — Paul Adams

(57) ABSTRACT

A levitation device that includes a housing, an adjustable launch platform, a base magnet, an adjustable attractor or repeller magnet, a leveling mechanism, and a spinning top incorporating a magnet.

21 Claims, 6 Drawing Sheets

(56) References Cited

U.S. PATENT DOCUMENTS

| | | | | |
|---|---|---|---|---|
| 2009/0179113 | A1* | 7/2009 | Belisle | B64G 1/002<br>244/166 |
| 2013/0093549 | A1* | 4/2013 | Wang | H02N 15/00<br>335/285 |

* cited by examiner

MAGNETIC LEVITATION DEVICE AND METHOD

FIELD OF THE INVENTION

The present invention relates to a magnetic levitation device and method wherein a permanent magnet is spun above a base magnet that produces a repelling magnetic field to the magnetic field of the spun magnet.

BACKGROUND OF THE INVENTION

The present invention has both educational and entertainment applications.

Typical magnetic levitation devices in the prior art using spin stabilization comprise two magnets, one that is fixed, called a base, and one that levitates above the base, sometimes referred to as a floater, levitating magnet, or floating magnet. The levitating or floating magnet in a field created by the base magnet is inherently unstable; however, some stability may be achieved by spinning the floating magnet. For example, the floating magnet may comprise a top having a vertically elongated stem with a vertical axis and a flat planar magnet mounted on the stem and having a first polar orientation. The fixed or base magnet also has a substantially vertical axis and a planar surface; the base magnet has been magnetized so as to create a repelling polar orientation to the polar orientation of the spinning top magnet, i.e., the North pole of the floating magnet is arranged at the lower end of the floating magnet, for example, to be adjacent the North pole of the base magnet arranged at the top of the base magnet. The repelling force produced by the polar magnetic fields suspends the floating magnet and the spin stabilizes its position and orientation.

In the prior art, as exemplified by U.S. Pat. Nos. 5,404,062 and 6,608,540, the user of the device spins the top on a flat non-magnetic plate so that its axis is generally co-linear with the axis of the base magnet. The user then raises the plate with spinning top to an elevation where the interaction of the opposing magnetic fields induces separation, that is, the lifting off, of the top from the plate. Sustained levitation of the top ensues and the plate is then lowered or removed.

Spinning the top requires considerable dexterity. The forces inherent in the operation, coupled with the magnetic interactions between the base and top, often cause the top to flip or be thrown from the field. Raising the lifter (or launch) plate can be done too quickly or jerkily, causing the top to be ejected from the levitation zone.

Still another problem in the prior art involves difficulty in launching the spinning top into the levitation state. In the prior art devices described above, when the plate is supported on the base magnet and the top is spun, it may occur that the interacting magnetic force between the base magnet and the spinning magnet is too great. In such event, the spinning top, when approaching or brought to the point of maximum upwardly directed force from the base magnet, literally jumps off the plate and thereby loses its stability and crashes. That is because the weight of the spinning top does not properly balance the upward levitating force produced by the interacting magnetic fields of the top and base. Conversely, despite continuous movement of the plate so as to find the point of maximum force generated by the base magnet, the spinning top may fail to rise from the plate. In that event, the weight of the spinning top is too great. In the prior art, adjusting the weight of the spinning top is effected by placing non-magnetic washers on, or removing them from, the stem of the top, thereby increasing or decreasing the weight of the spinning top to gaunter the difficulty described above in launching the spinning top. It is a trial-and-error process that can only be performed between flight attempts. In addition, the washers used to change the weight of the top are easily misplaced and, in any event, the incremental weight may be too crude to finely balance the forces.

In the prior art, achieving the correct horizontal orientation of the base magnet is also very crude and involves the placement of shims or wedges under one or more of the edges of the base magnet at an appropriate location, or the manipulation of leveling legs, to thereby tilt the base. In other words, the physical surface of the base magnet is tilted, changing the orientation of the substantially vertical axis of its magnetic field, thereby aligning the axis with that of the spinning top magnet. However, the shims and wedges are also easily misplaced and, in any event, finding their optimal location for placement beneath the base and then ascertaining the proper shimming or wedging height is tricky. Effecting proper orientation of the base using leveling legs presents a similar problem. The adjustment typically involves the difficult task of manipulating two legs an precise proportion through an estimating process. This method of base adjustment, like the shimming and wedging methods, often leads to unsuccessful launches, which can cause the user to become frustrated.

These and other deficiencies in prior art devices are overcome with the method and apparatus of the present invention.

SUMMARY OF THE INVENTION

The following summary of the invention provided to facilitate an understanding of some, though not necessarily all, of the innovative features in one or more embodiments of the invention that are unique; the invention is intended to be defined solely by the claims.

A levitation device that may include a housing and a launch platform, a base magnet having a magnetic field with a polar orientation along a substantially vertical axis; an attractor magnet having a magnetic field whose intensity of interaction can be varied and whose polar orientation is opposite to the polar orientation of the base magnet along a substantially vertical axis, or, alternatively, a repeller magnet having a magnetic field whose intensity of interaction can be varied and whose polar orientation is the same as the polar orientation of the base magnet along a substantially vertical axis; and a spinning top including a magnet having a magnetic field with a polar orientation opposite to the polar orientation of said base magnet along a substantially vertical axis.

A launch apparatus for a magnetically levitating, spinning top including a platform, a base magnet positioned below the platform, the base magnet having a field with a first polar orientation along a first axis, an attractor magnet having a field with a polar orientation opposite to the orientation of the base magnet, or, alternatively, instead of an attractor magnet, a repeller magnet having a field with a polar orientation that is the same as the polar orientation of the base magnet, the field of said attractor or repeller along an axis parallel to that of said base magnet and positioned below the platform, movable toward and away from the platform, and a spinning top including a magnet having a field with a polar orientation opposite to the base magnet polar orientation along a parallel axis when the top is spinning on and above the platform.

A spinning top having an axis and at least two axially spaced planar magnets, each of the planar magnets magnetized normal to the planar surface and parallel to the top axis so as to define a first polar orientation, the top having a vertically elongated stem, a first one of these at least two planar magnets movably mounted on the stem, a second one of the at least two magnets affixed to the stem, the first planar magnet being vertically adjustable relative to the second planar magnet whereby the repelling force of the spinning top magnetic field may be selected and varied, and at least one base magnet having a second axis parallel to the spinning top axis and a planar surface, the base magnet magnetized normal to the surface and parallel to the second axis so as to create a repelling polar orientation opposite to said spinning top polar orientation.

A method for launching a levitating spinning top comprising the steps of disposing a generally flat base magnet magnetized normal to the flat surface and parallel to a base axis so as to define a base polar orientation, arranging a launch platform over the base magnet that is vertically movable, mounting a flat attractor or repeller magnet below the platform such that the attractor or repeller magnetic field intersects the launch platform, said attractor or repeller magnet magnetized normal to the flat surface and parallel to the base axis so as to create, respectively, a repelling or attracting polar orientation to the base polar orientation, raising the platform to full elevation in the event that an attractor magnet is employed, or, in the event that a repeller magnet is employed, allowing the platform to remain at its minimum elevation, manually spinning a top having a flat magnet magnetized normal to the flat surface and coaxial with the top axis so as to define a top polar orientation that is repelling to the base polar orientation and the same as the polar orientation of an attractor magnet, but, opposite to the polar orientation of a repeller magnet, decreasing the magnetic field interaction of the attractor magnet, or, in the alternative case, raising the platform to full elevation and increasing the magnetic field interaction of the repeller magnet, with the top magnet as the top spins until the top levitates, and lowering the launch platform as the top continues to levitate, thereby maximizing the elevation of the top above the platform.

A method for adjusting the effective weight of a magnetic levitating spinning top comprising the steps of disposing a substantially flat base magnet on a substantially horizontal surface, the base magnet magnetized normal to the surface so as to define a base polar orientation, providing a spinning top having a vertically elongated stem, fixedly mounting a first flat magnet on the bottom end of the stem, the magnet magnetized in a direction normal to the surface so as to define a top polar orientation repelling the polar orientation of the base, mounting a second flat magnet at a first vertical position on the stem above the first magnet, the magnet magnetized in a direction normal to the surface so as to define a polar orientation the same as the polar orientation of the first flat magnet, spinning the top to levitate above the base magnet, determining whether the magnetic force interaction of the base and top magnets is of a magnitude suitable for sustaining levitation of the top and, if warranted, moving the vertical position of the second magnet on the stem toward or away from the fixed flat magnet on the stem to balance the lift force of the top to achieve substantially stable levitation.

DETAILED DESCRIPTION OF MULTIPLE EMBODIMENTS OF LEVITATING DEVICES IN ACCORDANCE WITH THE PRESENT INVENTION

Figure 1:
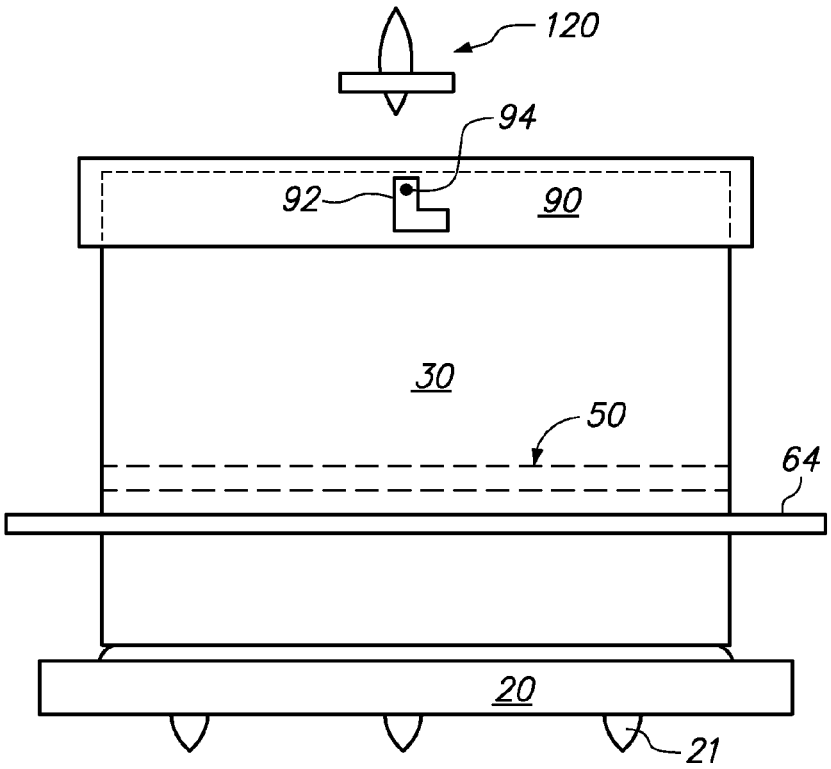
FIG. 1 is a front elevation view of one embodiment of a magnetic levitation device according to the present invention showing the top in the levitating or floating state.
Figure 4:
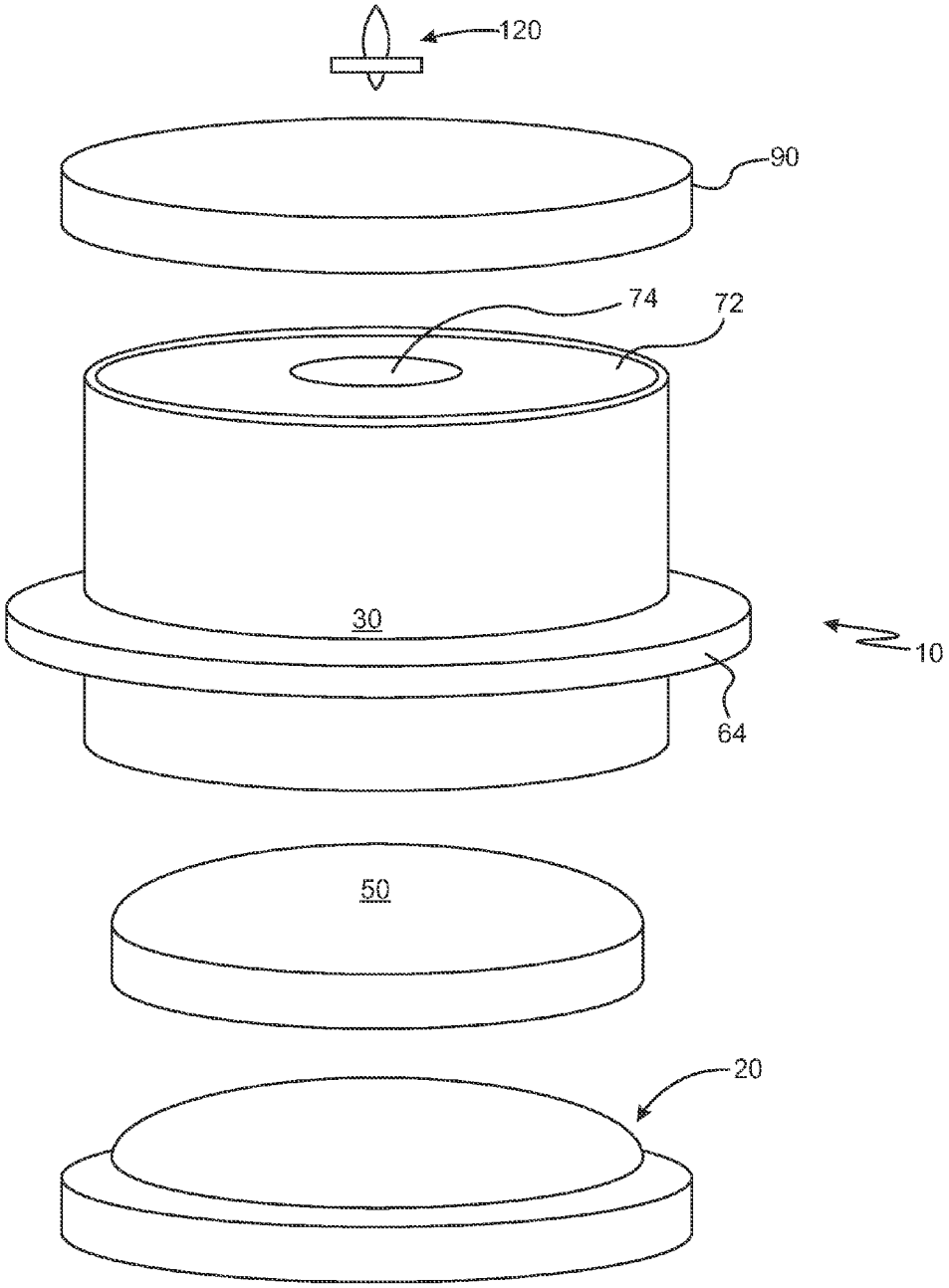
FIG. 4 is an exploded diagrammatic view of the principal sub-assemblies of the levitating device, including the top.
Figure 5:
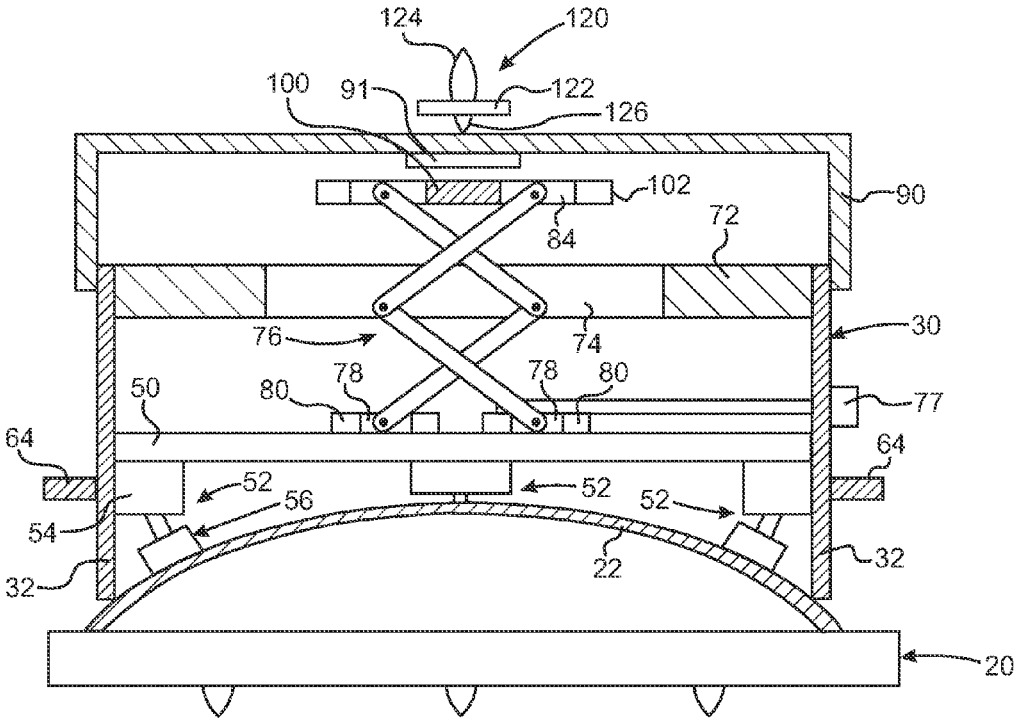
FIG. 5 is a vertical sectional view of the embodiment of a levitating device according to the present invention.

Referring now to FIGS. 1 and 4, there is shown a first embodiment of a levitating device indicated generally at 10 including a base 20, a housing 30, a plate 50, a launch platform 90, and a spinning top 120. The base and housing may be circular and cylindrical, respectively, although the housing may have any cross-sectional shape such as square, rectangular, oval, or an irregular shape. The base may be constructed of magnetic or non-magnetic material; the housing may be constructed from any type of non-magnetic material. In this first embodiment of the invention, the base 20 comprises a circular plate that may be formed from metallic or non-metallic material and includes at least three feet 21 on the bottom surface, preferably of rubber, so that the levitating device may be placed on a hard horizontal surface, such as a table, and will not inadvertently move. The details of several alternative embodiments of the housing 30 are described below. Within the housing 30 is a support plate 50, the structure and function of which will be described below. Above the plate 50 there is mounted a permanent base magnet 72 that may have a physical ring configuration, as shown in FIG. 5. Permanent base magnet 72 has a flat or planar shape with an axis that is perpendicular to the plane. The magnet 72 is magnetized so as to define a polar orientation normal or perpendicular to the magnet surface and generally parallel to the axis. It will be understood that various types of permanent magnets may be used, that is, the material may be Neodymium-Iron-Boron or other materials well known in the art and may be a single magnet homogeneously magnetized or selectively magnetized to produce the desired magnetic field. The base component 72 may also comprise multiple magnets that are arranged in a pattern so as to define a magnetic field that produces an upward magnetic force above the plane of the magnets. Nor is it necessary that the base magnets be flat, although that configuration may be preferable in order to provide the desired polar orientation that, as will be explained later, is opposite to the polar orientation of the magnet in spinning top 120, and most efficacious in providing a separating or repulsive force between the two magnets. The term "opposite to the polar orientation" of the spinning top magnet means that the spinning top magnet has a North pole at the top and a South pole at the bottom when the base magnet 72 has a South pole at the top and a North pole at the bottom. In short, the poles of the two magnets nearest one another are alike so as to produce a repelling force. Of course the poles of the spinning top magnet and permanent magnet 72 could be reversed so that the like poles of the magnets adjacent one another are North poles.

Figure 2:
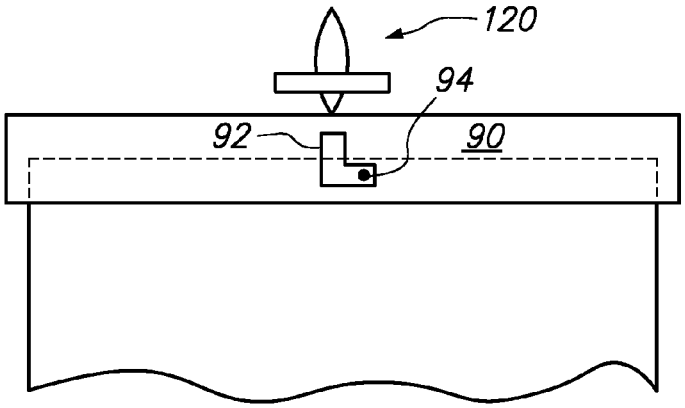
FIG. 2 is a partial view of FIG. 1, but showing the top in the pre-launch position.

As described with respect to the prior art, prior spin-stabilized levitation devices use a "lifter plate" held in one hand while the user spins the top with his or her other hand. The user then raises the lifter plate and top into a position where the upwardly directed magnetic force levitates the top, then proceeds to remove the lifter plate. Alternatively, the user may spin the top on the lifter plate as it rests atop the base magnet's housing. In the first embodiment of the levitation device as shown in FIGS. 1 and 2, a launch platform or stage 90 on which the top is spun to initiate the levitation launch is movably mounted on the top of housing 30. The platform 90 may be raised and lowered and is described in greater detail below. The vertically movable platform provides an advanced and improved way to launch the spinning, levitating top. Referring to FIG. 2, it will be seen that the platform 90 is in a raised position and the top 120 is in contact with the platform 90; that is, FIG. 2 shows the positions of the top and platform when the top is first spun to initiate the levitating process. Once the top is spinning, and the magnetic forces of the permanent magnet 72 are interacting with the magnet 122 of the top 120 as described below, the user may then slightly rotate the platform 90 and lower it. The top 120 is now stably levitated.

Figure 3A:
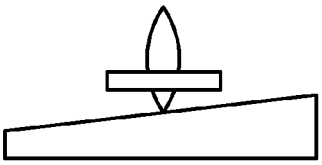
FIG. 3A is an alternative configuration for the launch platform of the levitating device shown in FIG. 1.
Figure 3B:
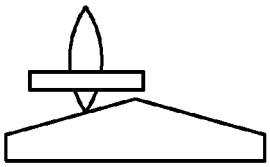
FIG. 3B is a second alternative configuration for the launch platform of the levitation device of FIG. 1.

FIGS. 3A and 3B show alternative platform 90 configurations for reasons best explained later when the function of the platform is explained in greater detail.

A second embodiment of a levitating device 10 is shown in vertical cross-section in FIG. 5, including means for leveling the base magnet 72 and platform 90 and thus, for controlling the location of the spun top on the platform and subsequently keeping it centered in flight. The first means for leveling the magnet 72 and launch platform 90 comprises a circular, convex ferromagnetic adjustment plate 22 disposed on base 20. Adjustment plate 22 may comprise a portion of a sphere or other solid curved geometric figure, disposed within housing 30. As seen best in FIG. 6, support plate 50 includes at least three and preferably four leveling feet 52, though the number of feet is not critical. Leveling feet include attachment members 54 that are mounted on the bottom surface of support plate 50, or may be mounted to the inside surface of the lower portion of cylindrical wall 32 of housing 30. Depending from each member 52 is a magnetic coupler 56 comprising a cylindrically shaped magnet 58 having a concave lower surface 60 in contact with convex plate 22. The magnet 58 has a stem 62 that is threaded so as to engage a threaded opening in the bottom of each attachment member 54. Magnets 58 may be coated so as to prevent direct contact with plate 22. The lower end of the stem 62 may have a ball joint (not shown) so that magnet 58 is flexibly connected to the stem 62 to effect proper contact with the surface of convex adjustment plate 22. The leveling feet 52 are adjusted so that the housing 30 rests entirely on the four magnetic coupling members 56; the lower peripheral edge of the wall 32 of housing 30 does not touch the base convex plate 22. This may be seen best in FIG. 6 where there is shown a gap or opening 65 between the lower peripheral edge of the housing cylindrical wall 32 and the base plate 22. Consequently, the horizontally of the platform 90 which rests atop the housing 30 is entirely linked to and dependent upon the positioning of the three or four leveling feet 52, which in turn rest on the convex plate 22 of base 20.

It will be seen from FIG. 5 that the user may apply hand pressure to the annular ring or handle 64 at any desired location so as to alter the axial orientation of the housing 30, and thus, of the housed permanent magnet 72, thereby tilting or leveling both. After tilting or leveling the housing 30, it maintains its position through the magnetic couplers 56 of leveling feet shown generally at 52 in cooperation with the convex adjustment plate 22. In this way, leveling may be effected and maintained along all substantially horizontal axes passing through the center of permanent magnet 72.

This means and method of leveling magnet 72 is greatly improved compared to the prior art where in order to level the permanent magnet base, individual shims must be placed at one or more locations along the periphery of the base, as seen in FIG. 4 of U.S. Pat. No. 6,608,540. By comparison, the leveling adjustment that may be performed using the embodiment shown in FIGS. 5 and 6 of the present invention allows simultaneous pitch and roll adjustment of the housing 30 and hence the housed permanent magnet 72. The platform 90 mounted atop the housing 30, in conjunction with permanent magnet 72, is leveled through movement of housing 30.

It will be understood from this first embodiment of a means for adjusting or leveling the horizontal orientation of the housed permanent magnet 72 and the launch platform 90 that the circular, convex adjustment plate 22 need not be ferromagnetic in which event the coupler 56 of leveling feet 52 may be made of non-magnetic material. The advantage of magnetically engaging the coupler and, by extension, attached housing components with the convex plate 22 is simply to hold the components in a preselected position after tilting the housing via the annular ring 64 relative to the base 20 and convex plate 22. Other means for maintaining the relative positioning of the housing 30 and convex adjustment plate 22 will be evident to those having ordinary skill in the art. Additionally, it will be evident to those having ordinary skill in the art that, in an alternative arrangement, the housing-to-convex plate linkage may be direct; that is, the leveling feet 52 and couplers 56 may be excluded, and the lower housing, through simple adaptation, may be coupled directly to the convex plate 22, engaged either magnetically or on-magnetically. It should further be understood that, although the method for tilting the housing employs the annular handle 64 that is exterior to the cylindrical wall 32, various other handles may be provided to assist in adjusting the housing 30 relative to the base 20.

In the FIG. 5 embodiment, there is also shown means for varying the strength of the repelling magnetic field by employing, in this case, an attractor magnet 100 in the upper section or chamber of housing 30. It should be noted that FIG. 5 depicts an attractor magnet by virtue of the relative positions of the top 120, platform 90, and magnet 100. The attractor magnet 100 in this embodiment has a flat or planar shape as seen in FIG. 5 and may have any horizontal cross sectional shape provided said shape is symmetrical about the magnet's axis. In the alternative case wherein a repeller magnet 100 is employed, said magnet would also have a flat or planar shape and could have any horizontal cross-sectional shape provided said shape is symmetrical about the magnet's axis. The attractor magnet 100 has an axis centrally located and perpendicular or normal to its planar surface, as does the alternatively employed repeller magnet. As an attractor, magnet 100 is magnetized so that it defines a polar orientation that is the same as the polar orientation of the magnet of top 120, that is, an attractive force between magnet 100 and the top magnet 122 is produced. As a repeller, magnet 100 is magnetized so that it defines a polar orientation that is the opposite of the polar orientation of the magnet of top 120, that is, a repelling force between magnet 100 and the top magnet 122 is produced. It will be understood that when the axis of the stem of the top 120 is in a generally vertical position as when the top is spinning, immediately preparatory to spinning, or levitating, the axis of the attractor or repeller magnet 100 will be generally parallel to and coaxial or nearly coaxial with the axis of the magnet 122 of top 120. A function of the attractor magnet 100 is to provide a magnetic field that urges the bottom of the spinning top down against the upper surface of the launch platform 90 and thereby to control, circumscribe, guide, retain or influence the position of the spinning top 120 in the central portion of the platform where the spinning top axis is approximately and desirably coaxial with the axis of the permanent magnet 72. In operation, the magnetic field of the attractor magnet interacts with the magnetic field of the magnet in top 120 as the launch process of the spinning of the top is commenced. The user then reduces the strength with which the magnetic field of the attractor magnet interacts with the magnetic field of the magnet 122 in top 120, thereby allowing or permitting the field of the base magnet 72 to repel the top magnet 122, that is, to support the top 120 in a levitation state. The function of the repeller magnet 100 is to controllably supplement the repelling force provided by the base magnet. In the event that a repeller is employed, its influence on the top as it is being spun is minimized. The position of the top on the platform upon initiation of spin is controlled by the interaction of the fields of the base magnet 72 and top magnet 122. In operation, the magnetic field of the repeller magnet significantly influences the magnet in top 120 when the user increases the intensity with which the magnetic field of the repeller magnet interacts with the magnetic field of the magnet 122 in top 120, thereby assisting the field of the base magnet 72 in repelling the top magnet 122 to induce and sustain levitation of the top.

Ignoring the relative positions of the top 120, platform 90, and magnet 100, FIG. 5 shows one embodiment for providing the means for varying the magnetic field interaction of the attractor or repeller magnet 100 with the top magnet 122. In this embodiment it will be seen from the sectional view in FIG. 5 that the attractor or repeller magnet 100 is a permanent magnet mounted in base plate 102 that may be vertically adjusted. As will also be seen from the sectional view in FIG. 5, the magnet 72 is in a physical ring shape with an opening 74 through which the means for raising and lowering attractor or repeller magnet 100 is accommodated. The means for vertically adjusting the position of the attractor or repeller magnet 100 comprises a scissor lift or member 76; the lower ends of the scissor arms are mounted in slots 78 in members 80 that are permanently fastened to the top surface of support plate 50. The upper ends of the scissor arms are likewise terminated in slots 84 in a baseplate 102 within which attractor or repeller magnet 100 is mounted. The scissor lift 76 is controlled by a suitable mechanism including a knob 77 that is mounted exteriorly of the housing 30.

The maximum lateral extent of the base plate 102 is less than the diameter of the opening 74 in ring magnet 72 permitting attractor or repeller magnet 100 to be raised or lowered through the opening 74 in base magnet 72. As shown in FIG. 5, which exemplifies the use of an attractor magnet, attractor magnet 100 has been raised to its uppermost position and is shown with the top 120 in contact with the upper surface of launch platform 90. In the position shown in FIG. 5, the attractor magnet 100 stabilizes the top 120 and circumscribes the horizontal zone within which it is spun. While the attractor magnet 100 attracts the magnet of top 120, the magnet 72, having an opposite polarity to the magnet of top 120, will tend to raise the top 120; that is, it will tend to push it upward, away from attractor magnet 100. The user then lowers the attractor magnet 100 whereupon the upward magnetic force of the base magnet 72 interacting with the top magnet will levitate the top 120. In contrast, employing a repeller magnet 100 instead of an attractor magnet, magnet 100 would be positioned at an elevation beneath the lower plane of the base magnet 72 such that its influence on the spinning top 120 would be negligible. The lower planar surface of the platform 90 would be positioned vertically adjacent to the base magnet 72 where the field geometry of said base magnet would be such that the top would be stabilized and centralized on the platform upon spin inducement. It should be noted, however, that the platform could be positioned at full elevation in the event that the user finds that maximum stabilization of the top during spin inducement is unnecessary. The user would then spin the top 120, raise the platform 90 (if not already in the elevated position), then raise the repeller magnet 100 whereupon the upward magnetic force furnished by the base magnet 72, together with the upward magnetic force furnished by the repeller magnet 100, would interact with the top magnet 122 so as to levitate the top 120.

It will be understood by those having ordinary skill in the art that a variety of mechanical, electrical, pneumatic and/or hydraulic devices may be used to raise and lower the platform 102 and attractor or repeller magnet 100. As an alternative means for varying the intensity of the interaction of the magnetic fields of the attractor or repeller magnet and the top magnet, magnet 100 may be an electromagnet that is fixedly mounted within the housing 30. The strength of the electromagnetic field that interacts with the magnetic field of the top magnet is adjusted by varying the current supplied to the electromagnet. In use, when it is desired to spin the top 120 and an electromagnet is to be employed as an attractor, for example, the electric current is increased so as to increase the magnetic field of electromagnet 100 and the attraction between the electromagnet and the magnet 122 in the top 120. When the user is ready to launch the top into a levitating state, the current in the electromagnet is adjusted so as to lessen the magnetic attraction. It will be readily understood that a movable permanent magnet or a fixed electromagnet or other means may be utilized for varying the interaction of the magnetic fields of the attractor or repeller magnet and spinning top magnet.

Figure 8:
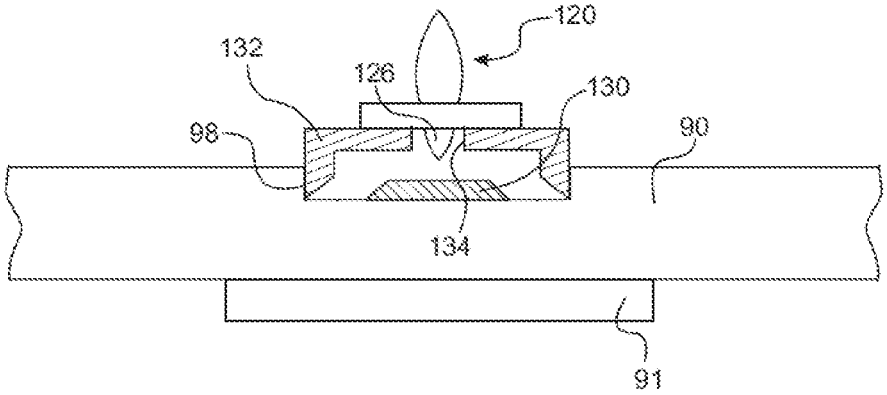
FIG. 8 is a partial sectional view of another embodiment of the stage or platform of a levitating device in accordance with the present invention.

In the embodiment shown in FIGS. 1, 2 and 5, where the launch platform 90 is vertically movable relative to the housing 30, an auxiliary copper disc, ring or other geometric configuration 91 may be secured to the bottom surface of the platform 90 as seen in FIG. 5 and FIG. 8, or it may be directly embedded within an opening in platform 90 or may comprise the entire platform 90; however, ill be understood that the present invention may be used with or without the auxiliary top-stabilizing copper component 91 in any of the described configurations of the platform and housing. The copper component is described in greater detail below.

Means for raising and lowering the platform 90 is shown in FIG. 1; this mechanical device comprises at least three L-shaped slots 92 in the sidewall of platform 90, each of which cooperates with a peg 94 permanently affixed to the housing 30 at circumferentially equidistant locations near the upper edge of housing 30. Alternatively, the plate 90 may be flat without any depending wall. The alternative settings of the platform 90, as shown in FIGS. 1 and 2, illustrate that the platform may be raised to the position as shown in FIG. 2 in preparation for starting the manual levitating process, and then, upon initiation of levitation, lowered to the position shown in FIG. 1 where the peg 94 is at the upper end of the slot 92. Other types of mechanical devices may include a telescoping action with adjustment for raising and lowering nested tubes. Compressed air could also be used to adjust the height of the platform mounted on a piston that may be moved through a vertically disposed cylinder. Similarly, a hydraulic cylinder and piston could also be used. Mechanical gear combinations including a vertical rack gear and a pinion that would be adjusted by the user is still another type of platform height adjuster. Thus, various means for raising and lowering the platform 90 and/or attractor or repeller magnet 100 may be used to commence the levitation process.

For the top 120, as seen best in FIG. 5, one embodiment may employ a ceramic magnetic ring 122 mounted on a spindle 124, the spindle having an engagement member 126 that contacts the surface on which the top is initially spun. The magnet 122 may also be a Neodymium-Iron-Boron magnet. Those skilled in the art will appreciate that a variety of different types of magnets in the top 120 and the ring magnet 72 may be utilized to obtain an economical and high performing interaction between the magnets during levitation. With regard to the magnet 72, although the embodiment in FIG. 5 shows a physical ring magnet, a variety of permanent magnet arrangements may be employed. For example, there may be discrete magnetic bars, cylinders, arcs, or other shapes that are suitably spaced and mounted in the upper end of the housing 30. As few as three bars or cylindrical magnets may be effective, in a triangular arrangement, to provide the desired magnetic field. Alternatively, two or more arcuate discrete magnets could be arranged in a circumferential pattern to provide the desired magnetic ring field. Or L-shaped magnets could be arranged either in a contiguous or a broken rectangular configuration with the junctions and termini of the legs of the L's nearest the wall of housing 30 at or near its upper extreme. Magnet materials, shapes and arrangements are well-known to those having ordinary skill in the art.

Figure 7:
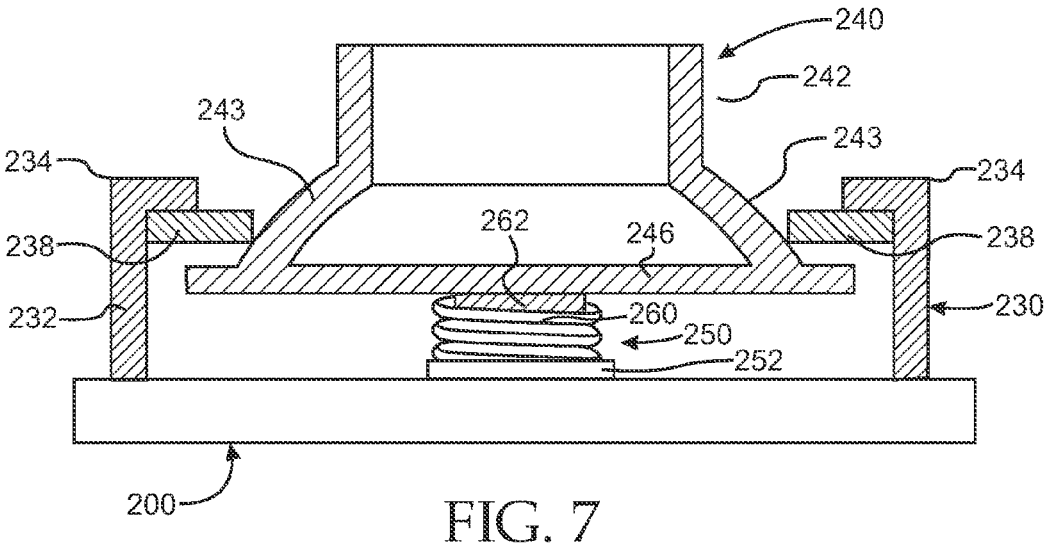
FIG. 7 is another embodiment of a levitating device according to the present invention.

Referring now to FIG. 7, there is shown an alternative means for centering the location of a spinning top on a platform by leveling the base magnet 72 and the platform 90 on which the top 120 is initially spun to commence the levitation process. In this embodiment, the base 200 supports a lower cylindrical housing 230 having a vertical cylindrical wall 232 that has an in-turned flange or annular member 234 at its upper edge. An adjustable housing 240 has a generally cylindrical shape including cylindrical wall 242 and a lower portion comprising an annular ring 243 having a convex shape that is of a spherical section and terminating in a flat circular plate 246 with a diameter slightly larger than the maximum diameter of annular ring 243 and less than the internal diameter of lower housing 230. Positioned above and in contact with ring 243 is a rubber ring or gasket 238 having a diameter slightly less than or substantially equal to the inner diameter of housing 230 and is attached to the bottom surface of annular member 234. A stanchion 250 comprising a base portion 252 and a cylindrical post (not shown) is positioned in the center of base 200 and centers compression spring 260 the upper portion of which bears against the segment of a sphere 262 mounted on the bottom surface of circular member 246, forcing the annular ring 243 of housing 240 against the gasket 238. Those skilled in the art will understand that the housing 240 may then be leveled by simply directing a horizontal force against the wall 242 to thereby tilt the base magnet 72 mounted in the upper portion of housing 240 and the platform 90 of the upper housing 240 in the manner described above. The projecting circumferential edge of circular plate 246 prevents the housing 240 from being tilted to the point of disengagement.

The method of controlling the location of a spinning top on a platform by leveling the base magnet 72 and the platform 90 as described with respect to base 20 and the engaging components of housing 30 in the first embodiment, or the ball and socket mechanism that engages lower housing 230 with upper housing 240 in the FIG. 7 embodiment, is performed by spinning the top on the platform and determining whether the top tends to move laterally toward the periphery of the platform rather than to remain in a relatively central position on the platform. If the top exhibits a lateral bias, correction is effected via adjustment of the leveling mechanism. As the top continues to spin, the attractor magnet 100 is gradually lowered and leveling refinements are made, if warranted; or, alternatively, as the top continues to spin, the repeller magnet 100 is gradually raised and leveling refinements are made, if warranted. It is important to note that even if the platform 90 and base magnet 72 are adjusted so as to be horizontal from the perspective of their relationship to the Earth, the magnetic field interaction between the top magnet 122, the base magnet 72, and the attractor magnet 100 may be such that, under the force of gravity, there is a bias or predilection of the top to wander from the central portion of the platform 90. Such wandering is not effected when employing repeller magnet 100.

Figure 6:
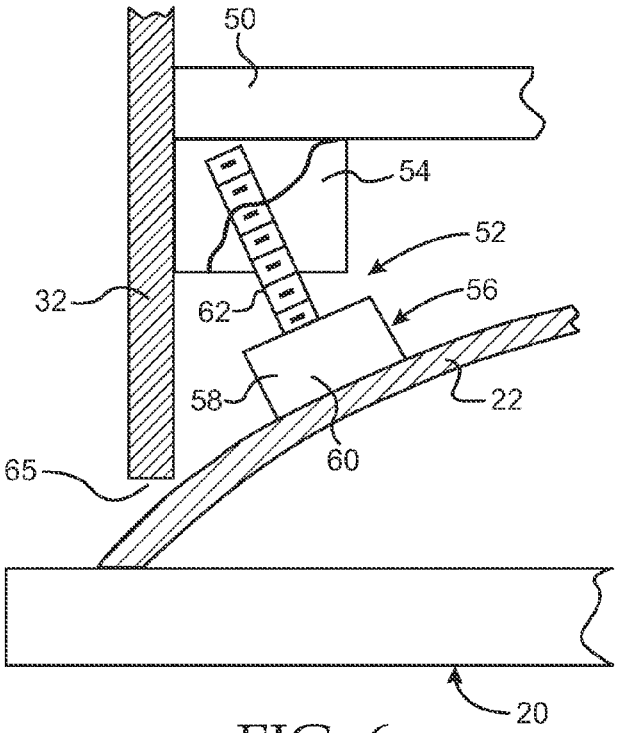
FIG. 6 is a detailed view of one leveling subassembly shown in FIG. 5.

The embodiment of FIG. 6 and the subassembly shown in FIG. 7 also provide more efficient, simpler, and more convenient means and method for adjusting the position of the base magnet and platform upper surface while providing stable support for the spinning top as levitation is commenced.

In summary with reference to FIGS. 6 and 7, one embodiment of the invention comprises the adjustment of the initial location of the spinning top on a launch platform by the steps of mounting the platform on a housing in a generally horizontal orientation, the housing containing a base magnet, then disposing a leveling device in the lower housing to permit tilting of the base magnet and platform, then spinning a top on the launch platform, and then manually adjusting the tilt of the base magnet and platform to center the top while it is spinning. If, subsequently, the top exhibits a lateral bias moving in or leaning toward a particular direction, the user manually tilts the base magnet and platform a second time so as to eliminate the bias. Adjustment may be repeated so as to optimize the location and predisposition of the top on the launch platform prior to launch so as to facilitate levitation.

Returning now to FIGS. 3A and 3B, it will be appreciated that the upper surface of the platform need not be parallel to the base. There are forces acting upon spinning top 120 other than gravity, specifically, the forces of the interacting magnetic fields of magnet 72, the magnet 122 of top 120 and the attractor magnet 100 (if used). In cases where the attractor magnet 100 is used, these interacting fields may urge the top 120 to wander from the central portion of platform 90. This wandering, which begins as a spiraling motion, and which, left unchecked, progresses into a circular or orbital motion, may be counteracted by using a platform at an angle to horizontal.

Still another embodiment of the present invention is shown in FIG. 8 specifically with respect to the underside of the platform 90 on which the top 120 is spun to commence the levitation process. As seen best in FIG. 8 with reference to platform 90, the platform lower surface may be provided with a copper disc or block 91 mounted below the center of platform 90. The function of the copper block or disc is to provide damping of eddy currents that may occur in the field of magnet 72, the action of which would otherwise cause an uneven or rough motion of the top 120 as it spins. By damping the eddy currents, the copper disc or block 91 allows the spinning top to assume a smooth, even motion. The precise physics of the copper disc when interacting with the ring magnet 72 and the spinning top magnet 122 is not entirely known. However, experiments have shown that the copper disc assists in pre-launch, launch, and post-launch spin stabilization of top 120. A copper disc or ring could also be mounted on or in the attractor or repeller magnet base-plate 102 in conjunction with, or in lieu of, copper disc 91. Furthermore, another, larger copper stabilizer in the form of a ring, for example, could be employed atop the base magnet 72, in conjunction with, or in lieu of, copper disc 91 and/or a base-plate-mounted copper disc or ring.

The planar portion of platform 90 may be provided with a circular shallow opening 98 into which is inserted a beveled-edged plastic or other non-metallic washer 130, which assists in pre-levitation spin by resisting any tendency of the top 120 to move laterally to ultimately assume an orbital motion rather than to remain in the central portion of the platform. The washer 130 is smaller in external diameter than the internal diameter of the circular opening 98 in the upper surface of platform 90 and it is of a thickness that precludes contact with the underside of magnet 122 of an upright top 120. A substantially cylindrical cap 132 of impact resistant and cushioning plastic having a beveled lower edge and central bore 134 in its upper wall may be inserted in opening 98 above washer 130. The purpose of the cap is to receive the bottom projection 126 of the spindle of top 120 in the hole 134 such that, upon cessation of levitation, the top will be captured and the potential for impact-generated damage to it, the device, or external objects or parts will thereby be eliminated. The bottom edge of the cylindrical wall of cap 132 is placed or slid into the circular shallow opening 98 of platform 90 after levitation has been initiated and the platform 90 has been lowered. In the event that the edge of washer 130 lies in contact with the vertical wall of the circular opening, the facing beveled edges of washer 130 and cap 132 ensure that the cap will seat satisfactorily. Capturing the spinning top when it discontinues levitation will reduce frustration of the user.

Figure 9:
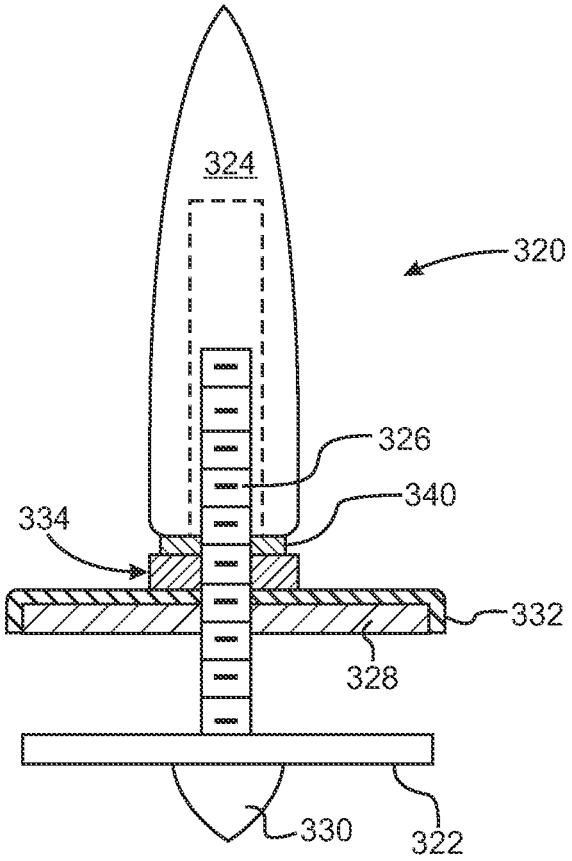
FIG. 9 is an enlarged, vertical sectional view of still another embodiment of a top for the present invention.

Turning now to FIG. 9, there is shown another embodiment of a top 320 comprising a magnet 322 similar to magnet 122 that provides the magnetic field of the spinning top. Top 320 also comprises a spindle 324 of any desirable elongated shape that will facilitate the manual spinning of the top; threadably engaged within the spindle 324 is a threaded shaft 326. The shaft 326 is permanently fastened to magnet 322 that is spaced below a second cylindrical magnet 328, said second magnet having a central opening through which the threaded shaft 326 passes. Beneath magnet 322 the spindle bottom portion 330 is fastened to and centered on the shaft 326. A cup-like cover of magnetic material 332 overlays and holds magnet 328 and has a central opening through which the threaded shaft 326 passes. Affixed to the upper face of the cover 332 is an annular member 334 that is thread ably connected to shaft 326. Affixed to the upper face of annular member 334 is a rubber friction washer or jam nut 340. Component 328 may alternatively consist of a threaded magnet or ferromagnetic washer, in which case cover 332 and affixed annular member 334 would not be required.

This alternative embodiment of a spinning top 320 permits adjustment of the lifting force on the top when the strength of the base-generated levitating magnetic force is fixed. In prior art devices, the force is varied by the manipulation of washer weights which are added to or removed from the spindle of the top. The embodiment of the top 320 permits force adjustment by arbitrarily spacing the magnets 322 and 328, typically in the range of one-eighth to one-quarter inch. This is performed by holding the edge of the cup 332 between the user's thumb and forefinger and twisting the spindle so as to loosen it from its engagement with friction washer 340. Magnet 328 may then be rotated downwardly toward magnet 322 to increase the repelling force of the magnetic field produced by magnets 322 and 328, in effect, decreasing the weight of the top; magnet 328 may be rotated upwardly, widening the distance between the magnets 322 and 328 so that the force is decreased, in effect, adding a washer weight to the spindle of the top as is typically done in prior art devices.

It will be understood that various constructions may be used to adjust the spacing of magnets 322 and 328 other than mounting on a threaded shaft. The positions of the movable and fixed magnets may be reversed on the shaft of the stem. Those skilled in the art will recognize that the magnetic field of the top may be raised in other ways to change the balance of forces.

The polar orientation of the adjustable center magnet 100 can be reversed such that it is repellent to the top magnet 122; that is, the orientation of the attractor magnet 100 can be reversed so as to function as repeller magnet 100. When the repeller magnet 100 is raised, the lift force exerted on the top magnet is increased. In this mode of operation, the center magnet 100 is initially set at a relatively low position; the top is spun on an adjustable launch platform positioned at the selected spin elevation—immediately above the base magnet to maximize spin securement and stability, or at lift-off elevation the operator finds that maximal securement and stabilizing force are unnecessary. If it is set at the lower elevation, upon initiating the spinning of the top 120, the platform 90 is raised and set at lift-off elevation. With the platform and spinning top at lift-off elevation, the center repelling magnet 100 is then raised until the top levitates. Subsequent levitations will not require center magnet adjustment (unless spin is initiated on a fully elevated platform); merely the spinning of the top, raising of the platform, and the observing of lift-off to levitation.

All references, including publications, patent applications, and patents, cited herein are hereby incorporated by reference. All methods described herein can be performed in any suitable order of the steps unless otherwise indicated herein or otherwise clearly contradicted by context. The use of any and all examples, or exemplary language (e.g., "such as") provided herein is intended to illuminate the invention and not to pose a limitation on the scope of the invention unless otherwise claimed. No language in the specification should be construed as indicating any non-claimed element is essential to the practice of the invention. This invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

I claim:

1. A levitation device comprising:

at least one base ring magnet mounted in a housing having a magnetic field and a magnetic axis with a polar orientation along a substantially vertical axis;

at least one movable magnet having a magnetic field whose intensity of interaction is selectively variable and a magnetic axis having a pre-selected polar orientation that is the same as, or opposite to, the polar orientation of the base ring magnet, said movable magnet thereby functioning respectively as a repeller or attractor magnet, said movable magnet magnetic axis substantially co-axial with said base ring magnet magnetic axis;

a vertically movable platform initially positioned at a lift-off elevation above said base ring magnet for supporting a spinning top prior to levitation when said pre-selected movable magnet is an attractor magnet and initially positioned below the lift-off elevation when said pre-selected movable magnet is a repeller magnet;

a spinning top including at least a first magnet having a magnetic field and a magnetic axis having a polar orientation opposite to said base ring magnet when said spinning top is spinning on or above said movable platform, said spinning top magnet magnetic axis substantially co-axial with said base ring magnet magnetic axis;

said movable magnet vertically adjustable from a first position above said base magnet and below said movable platform when said movable magnet is an attractor magnet at which the movable magnet magnetic field substantially interacts with said spinning top magnetic field, to a second position at which said spinning top is vertically lifted and stably sustained without any physical constraints above said movable platform; and said movable magnet vertically adjustable from a first position below said base ring magnet and below said movable platform when said movable magnet is a repeller magnet at which the movable magnet magnetic field negligibly interacts with said spinning top magnetic field, said platform is raised to the lift-off position, and said movable magnet is raised to a second position at which said spinning top is vertically lifted and stably maintained without any physical constraints above said movable platform.

2. The levitation device of claim 1 wherein said physical constraints include material constraints.

3. The levitation device of claim 1 wherein said physical constraints include mechanical constraints.

4. The levitation device of claim 1 wherein said movable magnet may be selectively positioned along its magnetic axis at any point within its range of movement below, within, or above said base magnet by passing through the ring.

5. The levitation device of claim 1 wherein said housing is mounted on a base and said housing and platform are selectively tiltable.

6. The levitation device of claim 5 wherein said base supports a lower portion of said housing and said housing is tiltable about its vertical axis.

7. The levitation device of claim 6 wherein said housing is gimbal-mounted on said base.

8. The levitation device of claim 7 wherein said vertically movable platform is supported on said housing.

9. The levitation device of claim 1 wherein said platform is substantially flat and normal to said axes, an area of its upper side having a recess at its center.

10. The levitation device of claim 9 additionally including a beveled-edged non-magnetic flat washer positioned in said recess and free to move laterally within the confines of said recess, the lower face of said washer resting flat against a bottom of said recess.

11. The levitation device of claim 10 wherein a substantially cylindrical cap of non-magnetic material having a beveled lower edge and central bore in its upper wall resides in said recess above and around said washer.

12. The levitation device of claim 1 wherein at least a portion of said platform is oriented at an angle relative to said axes.

13. The levitation device of claim 1 wherein said spinning top includes an elongated body having an axis parallel to said magnetic field axes when said top is spinning on or above said platform.

14. The levitation device of claim 13 wherein said spinning top additionally includes a second magnet adjustably mounted toward and away from said first spinning top magnet.

15. The levitation device of claim 14 wherein said elongated body includes a threaded shaft fixedly mounted in a body lower portion, said first spinning top magnet fixedly mounted on said shaft vertically adjacent said body lower portion, and said second magnet selectively vertically adjustable on said shaft.

16. The levitation device of claim 15 wherein said second magnet position on said shaft may be temporarily secured by frictional engagement of an upper portion of said elongated body with said second magnet.

17. The levitation device of claim 5 wherein said at least one movable magnet is mounted on a vertically adjustable member, the lower end of said vertically adjustable member fixedly mounted in said housing or on or within said base.

18. The levitation device of claim 17 wherein said vertically adjustable member is manually adjustable.

19. The levitation device of claim 1 additionally including means for damping magnetic field eddy currents, mounted below said platform and above said at least one movable magnet.

20. The levitation device of claim 19 wherein said eddy current damping means comprises a copper member selected from the group comprising a disc, ring, plate or other geometric configuration, and is mounted below said platform and above said at least one movable magnet.

21. A magnetic levitating device including a platform, a base magnet mounted below the platform and having a magnetic field with a polar orientation along a substantially vertical axis, the improvement comprising:

a spinning top including an elongated body having a first axis and upper and lower body portions interconnected by a threaded shaft fixedly mounted in the body lower portion, the upper body portion moveably, adjustably mounted on the threaded shaft;

a first dipole planar magnet fixedly mounted adjacent said lower body portion and having a magnetic field with a polar orientation opposite to the polar orientation of said base magnet when said spinning top is spinning relative the platform thereby creating a repelling force to a force of said base magnet magnetic field;

said spinning top including a second magnet movably mounted on said threaded shaft toward and away from said first magnet and having a magnetic field with a polar orientation that is the same as the polar orientation of said first magnet;

whereby adjustment of said second magnet increases or decreases the repelling force of the spinning top, effectively changing the weight of the top.

* * * * *